United States Patent [19]

Piesik

[11] 4,373,420

[45] Feb. 15, 1983

[54] COMBUSTION SUPPRESSOR

[75] Inventor: Edward T. Piesik, Pomona, Calif.

[73] Assignee: General Dynamics, Pomona Division, Pomona, Calif.

[21] Appl. No.: 194,533

[22] Filed: Oct. 6, 1980

[51] Int. Cl.[3] ..... F41F 3/04

[52] U.S. Cl. ..... 89/1.812; 89/1.817

[58] Field of Search ..... 89/1.812, 1.816, 1.817, 89/1.819, 1.809, 1.810, 1.8; 169/11; 244/114 B

[56] References Cited

U.S. PATENT DOCUMENTS

| | | | |
|---|---|---|---|
| 649,923 | 5/1900 | Febiger | 169/11 |
| 1,312,224 | 8/1919 | Wotherspoon | 169/11 |
| 1,993,695 | 3/1935 | Allen et al. | 169/11 |
| 2,050,687 | 8/1936 | Allen | 169/11 |
| 2,543,362 | 2/1951 | Getz | 169/1 |
| 2,693,240 | 11/1954 | Glendinning et al. | 169/2 |
| 2,756,215 | 7/1956 | Burgess et al. | 169/12 X |
| 3,052,303 | 9/1962 | Lapp | 89/1.812 X |
| 3,090,197 | 5/1963 | Lapp et al. | 89/1.812 X |
| 3,103,296 | 9/1963 | Gour | 169/12 X |
| 3,486,562 | 12/1969 | Goodloe et al. | 169/11 |
| 3,703,930 | 11/1972 | Loftstrand et al. | 89/1.812 X |
| 3,830,307 | 8/1974 | Bragg et al. | 169/11 X |
| 3,893,514 | 7/1975 | Carhart et al. | 169/46 |
| 4,044,648 | 8/1977 | Piesik | 89/1.812 X |
| 4,134,327 | 1/1979 | Piesik | 89/1.812 X |
| 4,173,919 | 11/1979 | Piesik | 89/1.816 X |
| 4,186,647 | 2/1980 | Piesik | 89/1.816 X |
| 4,324,167 | 4/1982 | Piesik | 89/1.812 |

*Primary Examiner*—David H. Brown

*Attorney, Agent, or Firm*—Henry M. Bissell; Edward B. Johnson

[57] ABSTRACT

Method and apparatus for preventing combustion of exhaust gases in rocket launch systems using a plurality of launch tubes connected to a plenum including pressure sensors in each launch tube, a control system sensitive to atmospheric pressure and launch tube pressure which provides a signal to an inert gas supply flow controller to initiate flow of gas into the plenum when pressure in a launch tube, after launch of a rocket, reaches a predetermined level.

8 Claims, 2 Drawing Figures

COMBUSTION SUPPRESSOR

BACKGROUND OF THE INVENTION

1. Field of the Invention

The present invention relates to suppression, if not prevention, of exhaust gas combustion in a multiple rocket exhaust plenum. More particularly, the present invention relates to a system for providing controlled flow of inert gases to a rocket exhaust plenum to prevent intake of oxygen which renders the exhaust mixture combustible.

2. Description of the Prior Art

For military applications rockets, missiles or other exhaust-gas propelled vehicles are often stored in closely adjacent magazines, chambers or launch tubes. In these cases, exhaust gas ducts are normally provided to convey rocket exhaust gases generated during rocket ignition to a safe location. Where available space is at a premium, as for example on board ship, manifolding of a number of closely adjacent launch tubes or chambers into a common exhaust manifold or plenum chamber is often necessary.

Various problems may develop if ducts connecting launch tubes to a common exhaust manifold are normally open before launch of the vehicles. If one or more of the rockets is intentionally or accidentally ignited, portions of the resulting exhaust gases, which may have temperatures as high as 6,000° F., can be circulated through the common manifold, into the connecting ducts and into other launch chambers. This could ignite other rockets. Also, the warheads in the launch chambers could be detonated by these hot gases. At a minimum, the gases could damage the rocket, associated equipment and hold-down devices. Thus accidental or intentional ignition of one rocket could render a whole ship or launching system ineffective. In addition, if the some of the launch tubes are open at their upper ends, exhaust gases entering the chambers through the connecting ducts could escape through the open outer ends.

More importantly, when a rocket is launched from a multiple rocket canister with a common plenum, a fuel rich exhaust gas mixture containing hydrogen and carbon monoxide is present in the empty launch tube and plenum. This can present a potential explosion hazard if air containing oxygen, e.g. from the atmosphere, is mixed into the system prior to the next rocket launch. Since these exhaust gas residuals are initially quite hot, up to 6,000° F. as noted, cool-down will naturally occur in the interval following launch and the internal pressure of the system will decrease. Even after the system is closed following the launch, it contains hot residual exhaust gases and other outgases from the system components, for example ablative materials, which are rich in hydrocarbons, carbon monoxide and hydrogen. As the pressure decreases external air can be drawn into the system, for instance, through the launch tube of the next launched rocket since it must be uncovered in order to allow the rocket to be launched. Thus, a system for preventing production of combustible mixtures in the plenum and in empty rocket launch tubes is needed.

The prior art discloses many different systems for utilizing a single plenum for the multiple firing of rockets from tubes. For instance, U.S. Pat. Nos. 4,044,648, 4,134,327 and 4,173,919 of the inventor herein all disclose systems utilizing a common exhaust duct to discharge exhaust gases produced by the firing of multiple rockets.

The need to detect fires and provides a means to control them is recognized in U.S. Pat. No. 3,052,303 of Lapp which discloses a system to extinguish inadvertently ignited rockets in a storage area by utilizing the pressure produced by the rocket exhaust to open a clapper valve and force water into the rocket's chamber until the ignition is extinguished. Glendinning et al. in U.S. Pat. No. 2,693,240 disclose another system to detect an explosion in aircraft during its initial phase and suppress the explosion by use of fire extinguishers.

It is also known in the prior art to utilize recirculated combustion exhaust materials, which are relatively inert, in order to provide a noncombustible atmosphere in closed containers. For instance, see U.S. Pat. Nos. 2,756,215 of Burgess et al. and 3,103,296 of Gour.

In another area of art, numerous patents have been issued which deal with methods of extinguishing fires or suppressing combustion after a fire has been initiated. Generally, these methods deal with the dilution of available air using some inert gas delivery method. For example, the following references are of interest: U.S. Pat. Nos. 649,923 of Febiger, 1,312,224 of Wotherspoon, 1,993,695 of Allen et al., 2,050,687 of Allen, 2,543,362 of Getz, 3,468,562 of Goodloe et al., 3,830,307 of Bragg et al. and 3,893,514 of Carhart et al.

SUMMARY OF THE INVENTION

In accordance with the present invention, apparatus is disclosed for sensing the pressure within each launch tube of a multiple rocket launching system having a manifold or plenum for exhausting gases from a plurality of rockets and providing an inert gas, such as nitrogen or carbon dioxide, to the plenum in order to keep the totality of the system slightly above atmospheric pressure and prevent entry of sufficient oxygen from the atmosphere to produce a combustible mixture in the launch tubes or the plenum. The launch tubes are provided with separately actuatable controllers which, for example, may be activated by signals corresponding to pressure decreases which occur during cooldown of the gases contained in a tube. The pressure sensor is connected to a control system which also receives a signal corresponding to atmospheric pressure outside the launch system. The control system is interconnected with, for example, a one-way valve which opens when provided with a signal from the controller. The one-way valve is provided in a conduit which communicates with a pressure regulator and a supply of pressurized gas, such as nitrogen. The pressurized gas is retained at a pressure sufficiently higher than the plenum pressure at the point of delivery to the plenum to facilitate rapid dispersion of the gas into the system.

The result of this system is the prevention of oxygen flow from the external atmosphere into the plenum system, since the pressure in the system is maintained above atmospheric. Thus, small leaks and openings, such as the cover for the rocket which has been launched, do not present the problems relating to fire hazards which have previously existed.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

The system of the present invention is basically directed to the provision of positive pressure inside the launch tubes and the plenum of a multiple launch tube system for firing rockets or missiles. This is accomplished by sensing the pressure in the launch tube from which a rocket has been fired and in the interconnecting plenum and initiating the input of an inert gas, such as nitrogen or carbon dioxide, into the plenum chamber and launch tube prior to the admission of sufficient oxygen from the atmosphere to produce a combustible mixture. The overall pressure in the system is maintained at a sufficient level that the gas in the system tends to flow out of the exhaust plenum after firing of the rocket and, thus, prevents entry of external gases into the system.

Figure 1:
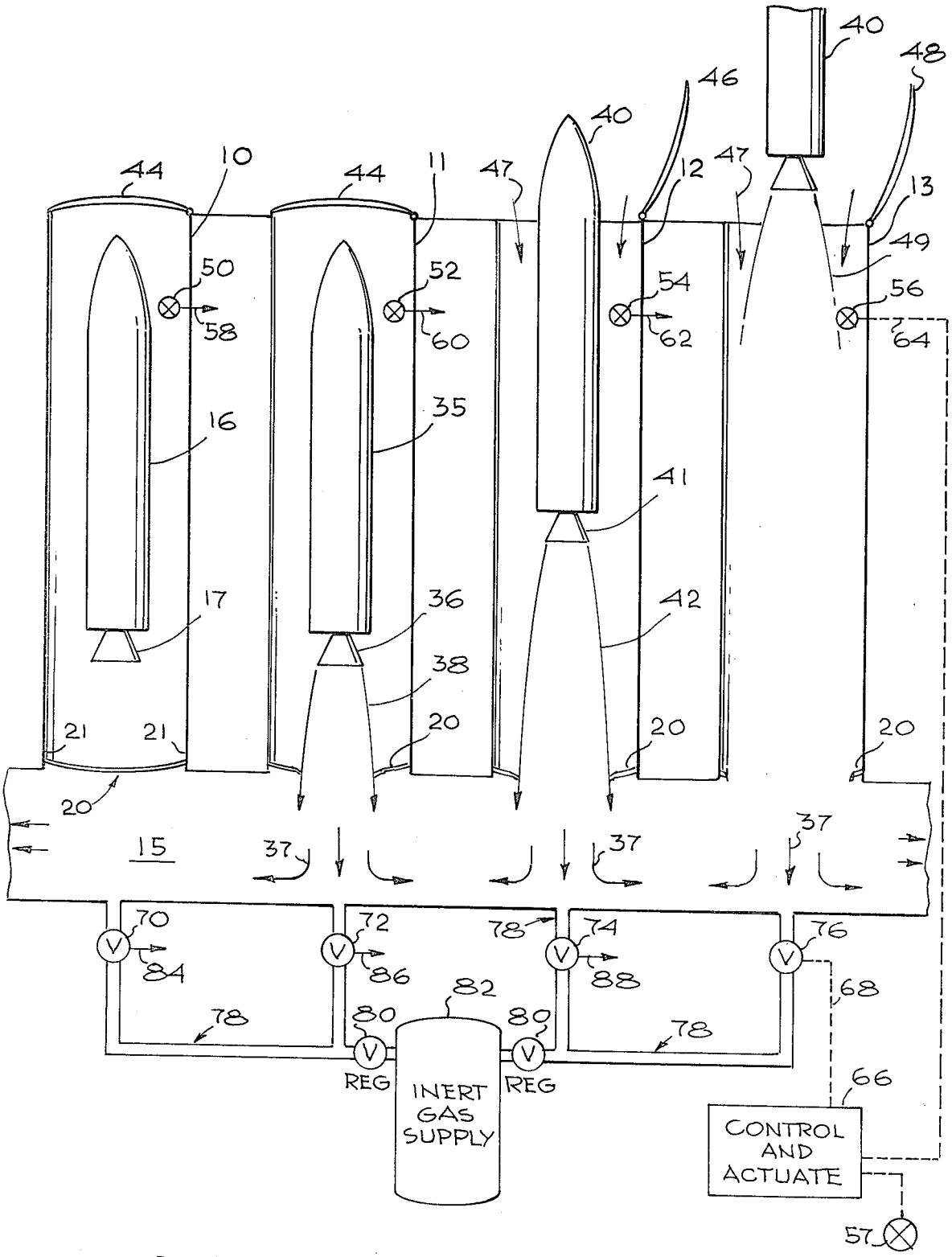
FIG. 1 is a schematic side elevation view illustrating a plurality of launch tubes having rockets therein at different stages of launch, and showing the mechanical portions of the sensing system of the present invention.

Referring now to the drawing, and more particularly to FIG. 1, there is schematically illustrated a rocket launching installation which includes a plurality of launch tubes 10, 11, 12 and 13. It will be understood that the number of launch tubes is arbitrary and that more or fewer tubes may be provided.

The launch tubes are connected to a common duct or plenum chamber 15 for conducting the exhaust gases created by firing the rockets in launch tubes 10–13 away from the launch tubes. It will, of course, be understood that, instead of rockets, missiles or other exhaust-propelled vehicles may be utilized. Launch tube 10 illustrates a rocket 16 disposed therein. The rockets may be held by suitable hold-down devices (not shown), such devices being well known to those skilled in the art. The rocket is provided with an exhaust nozzle 17 through which the hot exhaust gases emerge.

The bottom of launch tube 10 is closed with a frangible cover 20. However, other rear closure systems known to those skilled in the art may be utilized. The cover is secured to the walls 21 of launch tube 10 by any suitable manner, for example, by welding or suitable fastening devices. The frangible cover 20 is shown in various stages of destruction by the exhaust of the rockets in tubes 11, 12 and 13.

In tube 11, rocket 35 has been ignited and nozzle 36 is emitting exhaust plume 38 which is exiting into plenum 15 producing pressure and exhaust gas flow as indicated by arrows 37. The rocket is yet to be released from its hold-down device, and thus cover 44 is still in position, as is cover 44 of tube 10.

In tube 12 cover 46 is open and rocket 40 is proceeding upward while emitting an exhaust plume 42 from nozzle 41. This also results in gas pressure in plenum 15, as indicated by arrows 37. The temperature of the exhaust plume 42 is quite high, up to about 6,000° F., and, due to the downward flow of gases produced by plume 42, external atmospheric gases indicated by arrows 47 may begin to enter tube 12. In tube 13, rocket or missile 40 has exited the tube and is adjacent open cover 48. At this point plume 49 impinges upon tube 13 in the area of sensor 56 and will be drawing external atmospheric gases into tube 13 as indicated by arrows 47. During this time, the atmospheric oxygen may cause burning of some of the exhaust gases 49, thus merely increasing the normal combustion of the exhaust gases without adding to the problem of preventing combustion of residual fuel-rich gases after the launch is completed.

Tubes 10, 11, 12 and 13 are provided with pressure sensors 50, 52, 54 and 56, respectively. Each pressure sensor is connected via lines 58, 60, 62 and 64, respectively, to a controller for activation in the system of the present invention. A sensor 57 is also connected to the control/actuate stage 66 for providing an indication of atmospheric pressure for comparison purposes. For purposes of illustration, line 64 from sensor 56 is shown connected to controlling and actuating unit 66. It is to be understood that a single multifunction control unit may be utilized for all of the pressure sensors, or individual circuitry may be provided for each unit. The control and actuation unit 66 is connected, as shown by line 68, to control valve 76 in gas line 78 which is interconnected through regulating valve 80 to inert gas supply 82.

As illustrated, valve 70 would be connected through line 84 to a control unit, not shown, which would receive signals from line 58 attached to sensor 50 in tube 10. Valve 72 would be interconnected through line 86 to a control unit, not shown, which would receive signals from line 60, connected to sensor 52. Likewise, valve 74 would be actuated by interconnection with line 88 to a control unit which receives signals from line 62 connected to sensor 54.

The opening of any of valves 70, 72, 74 and 76 provides inert gas from supply 82 through feed lines 78. Lines 78 are provided with regulators 80 to control the pressure of the inert gas contained in supply 82 and transmitted to plenum 15. Exemplary inert gases include nitrogen and carbon dioxide, both of which do not provide a combustible mixture when mixed with exhaust gases from the rockets. Generally, the rocket's exhaust contains hydrogen and carbon monoxide; thus it is necessary to prevent oxygen from entering the system and, especially, to prevent any mixtures containing hydrogen and oxygen from reaching the very high temperatures present in the exhaust plume of a rocket, since these high temperatures could result in a violent combustive reaction occurring.

It is to be understood that due to factors such as the number of launch tubes and the length and direction of flow of the gases in plenum chamber 15, different feed positions for the gas may be provided. In fact, sensors 50, 52, 54 and 56 may be connected to a single control and actuator device which opens a single regulated valve if such a system will provide the required safety, i.e. prevent sufficient oxygen from reaching the plenum chamber to produce a combustible mixture.

Further, it is to be understood that the launch tube covers shown open in this drawing, i.e. covers 46 and 48, will close and seal after firing of the rocket, and the plenum will close and seal through use of appropriate cover(s), not shown. It is further understood that if the launch tube rear cover is closed after firing the rocket, a pressure sensor in the plenum would be incorporated to function as sensors 50, 52, 54, 56 and in addition to them.

Figure 2:
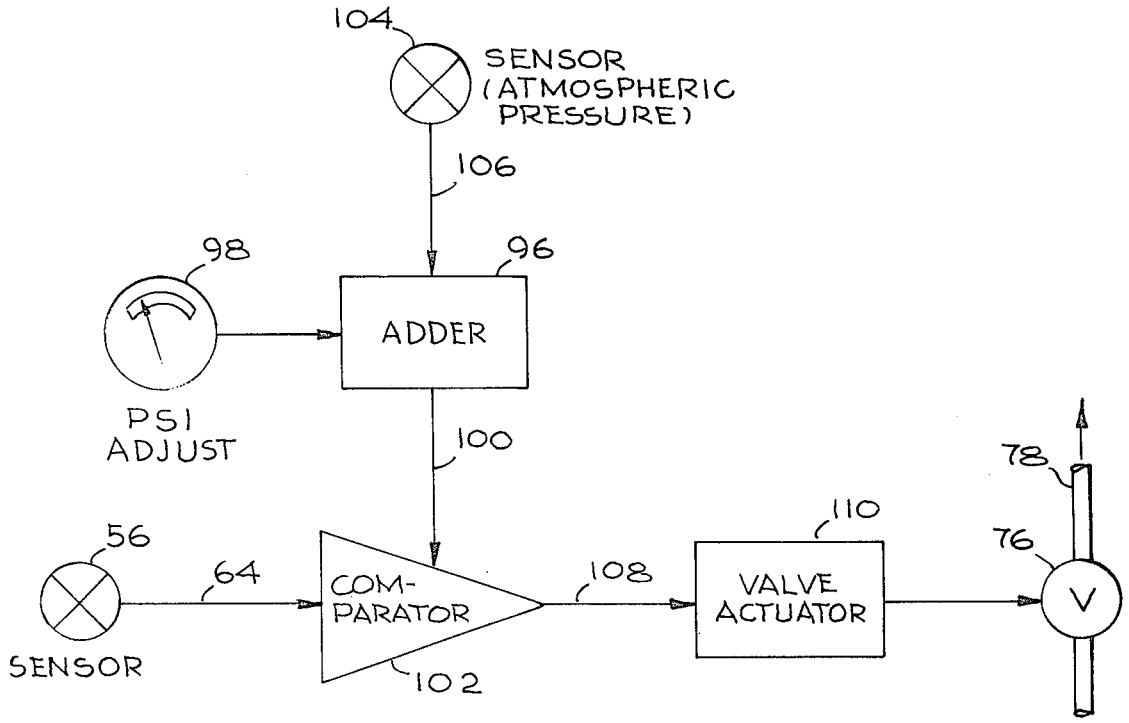
FIG. 2 is a schematic drawing of a control system of the present invention.

FIG. 2 schematically illustrates the preferred control and actuating circuitry of the present invention. In the figure, a pressure signal is generated at sensor 56 and carried by line 64 to comparator 102. Atmospheric pressure is represented by a signal from pressure sensor 104 and carried by line 106 to adder 96 which sums the signal with an adjustable signal provided to adder 96 by psi adjuster 98. As illustrated, psi adjuster is variable both in the positive and negative directions to result in either an increase or decrease in the signal received from sensor 104. In the preferred form the psi adjuster 98 would be set at +1 psi and the output signal from adder 96 carried in line 100 would be the atmospheric pressure plus 1 psi. Adder output in line 100 is provided to comparator 102 which also receives a signal representative of launch tube pressure from pressure sensor 56 through line 64. The signal carried in line 64 would be connected to the comparator, such that when the atmospheric pressure, plus 1 psi, is greater than the launch tube pressure, comparator 102 provides a signal through line 108 to valve actuator 110 which opens valve 76 and allows gas to pass through line 78, as indicated by the arrows. In this manner, the system will operate to feed inert gas into plenum chamber 15 when the pressure at sensor 56 is equal to or less than 1 psi above atmospheric pressure.

In an optional system, the atmospheric pressure sensor 104 could be eliminated, and the comparator provided with a fixed base signal for comparison, i.e. 14.7 psi. This system, of course, would function quite well for situations where the variations in atmospheric pressure are not sufficiently great to necessitate the comparison. Additionally, in this optional system, then, the adder which enhances a portion of the signal could be eliminated, as well, and the fixed signal provided to the comparator could be adjusted upwardly or downwardly to provide for the desired pressure differential. For instance, a fixed signal provided to the comparator could be set at a level corresponding to a pressure of 15.7 psi, and thus the comparator would provide a signal to the actuator when the pressure in the associated launch tube was less than or equal to 15.7 psi.

In systems with which the present invention may be associated, only a decrease in the system pressure below the atmospheric pressure plus, say, 1 psi causes air (oxygen) to flow into the system and possibly result in combustion of the residual exhaust gases. The inert gas is needed in the system when the system pressure decreases. The inert gases are arranged to flow into the system at any time that the pressure is less than approximately 1 psi above atmospheric pressure.

Although there have been described above specific arrangements of a combustion suppressor for a multiple launch tube rocket system in accordance with the present invention for the purposes of illustrating the manner in which the invention may be used to advantage, it will be appreciated that the invention is not limited thereto. For example, although the invention has been disclosed in the association with four launch tubes and a manifold system therefor, the principles of the invention are equally applicable to any comparable system for the enclosed firing of rockets or the like. Accordingly, any and all modifications, variations or equivalent arrangements which may occur to those skilled in the art should be considered to be within the scope of the invention as defined in the appended claims.

What is claimed is:

1. Apparatus for suppressing exhaust gas combustion in a rocket launching system comprising:
   - a plurality of rocket launch tubes having exhaust gas exits;
   - at least one plenum interconnecting the exhaust gas exits of said tubes and communicating with a common exhaust;
   - pressure sensing means effective to provide signals corresponding to pressures in the launch tubes and plenum;
   - activating means responsive to the signal from said pressure sensing means operatively interconnected with inert gas flow control means including a valve and effective to selectively open said valve; and
   - inert gas supply means interconnected with said plenum through said flow control means,
   - whereby said activating means opens said flow control means when the pressure in a launch tube reaches a predetermined level during launch of a rocket and inert gas from said supply means is provided to said plenum in amounts sufficient to maintain said plenum pressure sufficiently above atmospheric pressure to prevent intake of atmospheric gases.

2. The apparatus of claim 1 wherein said pressure sensing means includes a pressure sensor in each launch tube effective to provide individual signals indicative of the pressure in each tube.

3. The apparatus of claim 1 wherein the pressure sensing means includes a second pressure sensor effective to provide a signal indicative of atmospheric pressure.

4. The apparatus of claim 3 further comprising means to adjust the signal received from said second pressure sensor by a predetermined amount.

5. The apparatus of claim 2 further comprising means to compare the signal from said pressure sensing means with a second signal, whereby when the signal from said pressure sensing means falls below the second signal the system is activated.

6. The apparatus of claim 5 further comprising means to adjust the second signal by a predetermined amount prior to comparison with the signal generated by said pressure sensing means.

7. A method of suppressing exhaust gas combustion in a multiple rocket launching system comprising a plurality of rocket launch tubes having exhaust gas exits and a plenum chamber interconnecting said exhaust gas exits and communicating with external exhaust means, said method comprising:
   - sensing the pressure in the launch tubes during firing of the rockets;
   - determining when the pressure in said launch tube falls below a preselected level; and
   - providing a supply of inert gas to said plenum when pressure in said launch tube falls below said preselected level in a quantity effective to prevent ingress of combustible atmospheric gases into said plenum.

8. The method of claim 7 further comprising sensing the ambient atmospheric pressure adjacent the launch tube and supplying the inert gas to the plenum when the launch tube pressure falls below a preselected amount above a sensed atmospheric pressure.

* * * * *